US009674610B2

(12) United States Patent
Kim et al.

(10) Patent No.: US 9,674,610 B2
(45) Date of Patent: Jun. 6, 2017

(54) MOBILE DEVICE AND METHOD FOR CONTROLLING SPEAKER

(71) Applicant: SAMSUNG ELECTRONICS CO., LTD., Suwon-si (KR)

(72) Inventors: Nan-ho Kim, Suwon-si (KR); Young-soo Kang, Seoul (KR); Gyeong-jin Park, Suwon-si (KR); Sang-woong Lee, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 77 days.

(21) Appl. No.: 14/550,109

(22) Filed: Nov. 21, 2014

(65) Prior Publication Data

US 2015/0256926 A1 Sep. 10, 2015

(30) Foreign Application Priority Data

Mar. 5, 2014 (KR) ..... 10-2014-0026027

(51) Int. Cl.
*H04R 3/12* (2006.01)

(52) U.S. Cl.
CPC ..... *H04R 3/12* (2013.01); *H04R 2227/005* (2013.01); *H04R 2420/01* (2013.01); *H04R 2420/03* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 7,817,960 | B2 | 10/2010 | Tan et al. | |
| 8,190,203 | B2 * | 5/2012 | Pelland | H04M 1/0254 381/74 |
| 9,060,288 | B2 * | 6/2015 | Pelland | H04W 24/02 |
| 2008/0031470 | A1 | 2/2008 | Angelhag | |
| 2008/0159561 | A1 * | 7/2008 | Parker | G06F 9/4418 381/94.5 |
| 2010/0299639 | A1 * | 11/2010 | Ramsay | G06F 3/0486 715/835 |
| 2013/0080599 | A1 | 3/2013 | Ko et al. | |
| 2014/0010398 | A1 * | 1/2014 | Wang | H04M 1/6066 381/375 |
| 2014/0256249 | A1 * | 9/2014 | Tse | H04B 5/0031 455/41.1 |

FOREIGN PATENT DOCUMENTS

| | | |
|---|---|---|
| JP | 2007-228471 | 9/2007 |
| JP | 4083361 | 2/2008 |
| KR | 10-2009-0103953 | 10/2009 |
| KR | 10-1059299 | 8/2011 |
| KR | 10-2012-0125040 | 11/2012 |

* cited by examiner

*Primary Examiner* — Paul Huber
(74) *Attorney, Agent, or Firm* — Staas & Halsey LLP

(57) ABSTRACT

A mobile device including an audio processor processing audio data and generating an audio signal, an outputter outputting the audio signal, a communicator that may be connected to an AP (Access Point) network, and a controller, in response to a predetermined event occurring with the audio signal being output, transmitting the audio signal to an external speaker included in the AP network through the communicator and controlling the external speaker to output the audio signal.

13 Claims, 13 Drawing Sheets

MOBILE DEVICE AND METHOD FOR CONTROLLING SPEAKER

CROSS-REFERENCE TO RELATED APPLICATIONS

This application claims priority from Korean Patent Application No. 10-2014-0026027 filed in the Korean Intellectual Property Office on Mar. 5, 2014, the disclosure of which is incorporated herein by reference.

BACKGROUND

1. Field

Methods and apparatuses consistent with the embodiments relate to a mobile device and a speaker controlling method thereof, and more particularly, to a mobile device capable of controlling operations of at least one speaker connected to a same network, and a speaker controlling method thereof and a system.

2. Description of the Prior Art

A data processing apparatus such as a desktop or notebook includes a hard disk or a memory where various data or files may be stored. Furthermore, when necessary, a data processing apparatus may read and execute data or files, and transmit the read or executed data or files to an external apparatus.

A data processing apparatus may transmit an audio signal that signal processed audio data stored in a hard disk or memory or audio signals received from an external server (for example, internet server or broadcasting station server) to an external speaker connected via a network. Therefore, the data processing apparatus may output an audio signal through an external speaker so that a user may hear it.

The external speaker may be a general speaker that only performs operations of outputting an audio signal, or a speaker included in a mobile device.

However, a conventional data processing apparatus could transmit an audio signal to one of a general speaker and a mobile device. Therefore, a user needed to manually select an external speaker to output an audio signal using the data processing apparatus, and also in the case of converting a speaker to output an audio signal from a general speaker to a mobile speaker, the user had to manually select the speaker.

Furthermore, it is possible to have a mobile device transmit an audio signal to a general speaker, and have the audio signal be output through the general speaker. However, since the mobile device can control only one speaker at a time, it is not possible to control a plurality of speakers at the same time. Therefore, there is needed an easy way to control an external speaker.

SUMMARY

The purpose of the embodiments is to provide a mobile device that is capable of controlling operations of at least one speaker connected to a same network, and a speaker controlling method thereof.

According to an embodiment, there is provided a mobile device including an audio processor processing audio data and generating an audio signal; an outputter outputting the audio signal; a communicator that may be connected to an AP (Access Point) network; and a controller, in response to a predetermined event occurring with the audio signal being output, transmitting the audio signal to an external speaker included in the AP network through the communicator and controlling the external speaker to output the audio signal.

Meanwhile, the controller, in response to the mobile device accessed or having access to the AP network, may transmit the audio data to the external speaker included in the AP network.

Meanwhile, the outputter may include a jack connector to which an earphone jack may be connected, and in response to the earphone jack being connected thereto, outputting the audio signal through the earphone jack. In this case, the controller, with the earphone jack connected to the jack connector and the mobile device accessed to the AP network, in response to the earphone jack being detached from the jack connector, may transmit the audio data to the external speaker included in the AP network.

Meanwhile, the communicator may include an NFC (Near Field Communicationchip for performing a short-distance wireless communication. In this case, the controller, in response to the mobile device being tagged to the external speaker, may transmit the audio data in the short-distance wireless communication method.

The mobile device may further include a displayer. In this case, the controller, in response to the external speaker being plural, may display a UI (User interface) screen for selecting an external speaker to output the audio signal of a plurality of external speakers, and transmit the audio signal to the external speaker selected on the UI screen.

Furthermore, the controller, in response to the plurality of external speakers being grouped into one group on the UI screen, may transmit a same audio signal to the external speakers in the group.

Meanwhile, the controller, in response to the audio signal including a plurality of channel signals and the plurality of external speakers being grouped in a plurality of channel groups on the UI screen, may transmit a channel signal corresponding to each group.

Furthermore, the controller, in response to a speaker conversion command being input with a first external speaker of the plurality of external speakers included in the AP network outputting the audio signal, may stop transmitting the audio signal to the first external speaker, transmit the audio signal to a second external speaker of the plurality of external speakers, and control the second external speaker to output the audio signal.

Meanwhile, the controller, in response to the external speakers being plural, may transmit an audio signal of different volume level according to a distance between each of the plurality of external speakers and the mobile device to each of the plurality of external speakers and output the audio signal.

Meanwhile, the communicator may communicate with a data processing apparatus included in the AP network and receive the audio data from the data processing apparatus.

According to an embodiment, there is provided a speaker controlling method of a mobile device, the method including processing audio data and generating an audio signal; outputting the audio signal; and in response to a predetermined event occurring with the audio signal being output, transmitting the audio signal to an external speaker included in a same AP network as the mobile device, and controlling the external speaker to output the audio signal.

Meanwhile, the controlling the external speaker, in response to the mobile device being accessed to the AP network, may transmit the audio data to the external speaker included in the AP network.

The outputting may output the audio signal through an earphone jack connected to a jack connector of the mobile device. In this case, the controlling the external speaker, with the earphone jack connected to the jack connector and the mobile device accessed to the AP network, in response to the earphone jack being detached from the jack connector, may transmit the audio data to the external speaker included in the AP network.

Meanwhile, controlling the external speaker, in response to the mobile device being tagged to the external speaker, may transmit the audio data in a short-distance wireless communication method.

Furthermore, the controlling the external speaker may include, in response to the external speaker being plural, displaying a UI screen for selecting an external speaker to output the audio signal of a plurality of external speakers; and transmitting the audio signal to the external speaker selected on the UI screen.

Meanwhile, the controlling the external speaker, in response to the plurality of external speakers being grouped into one group on the UI screen, may transmit a same audio signal to the external speakers in the group.

Furthermore, the controlling the external speaker, in response to the audio signal including a plurality of channel signals and the plurality of external speakers being grouped into a plurality of channel groups on the UI screen, may transmit a channel signal corresponding to each group.

Meanwhile, the controlling the external speaker, in response to a speaker conversion command being input with a first external speaker outputting the audio signal of the plurality of external speakers included in the AP network, may stop transmitting the audio signal to the first external speaker, transmit the audio signal to a second external speaker of the plurality of external speakers, and control the second external speaker to output the audio signal.

Furthermore, the controlling the external speaker, in response to the external speaker being plural, may transmit an audio signal of different volume level to each of the plurality of external speakers according to a distance between each of the plurality of external speakers and the mobile device, and output the audio signal.

According to an embodiment, there is provided a system including an audio speaker; a network connected to the speaker; and a smart phone connectable to the network and causing an audio signal to be sent to the speaker when an event occurs in the smart phone.

BRIEF DESCRIPTION OF THE DRAWINGS

The above and/or other aspects of the present disclosure will be more apparent by describing certain present disclosure with reference to the accompanying drawings, in which.

DETAILED DESCRIPTION

Figure 1:
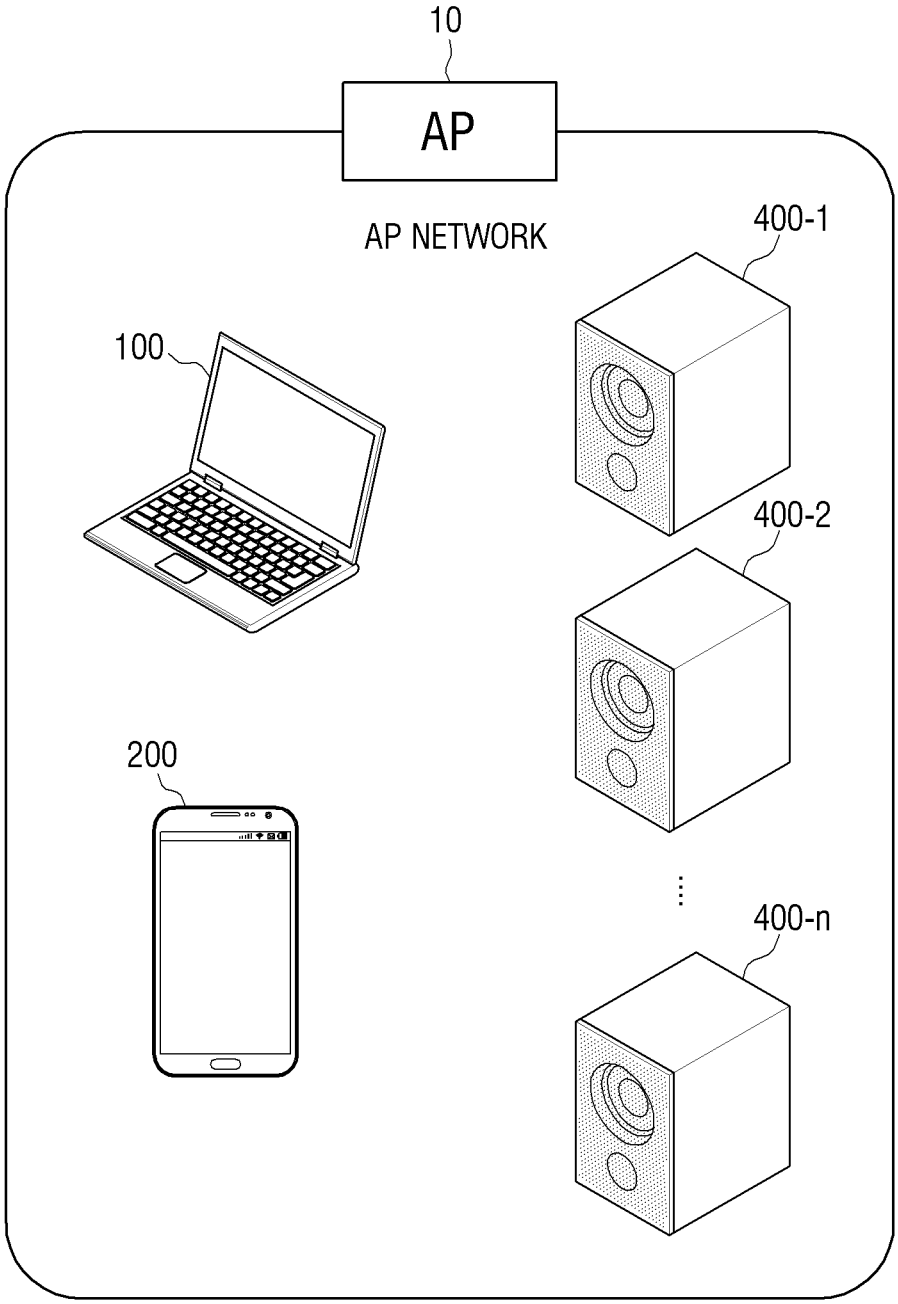
FIG. 1 is a view illustrating a speaker control system according to an embodiment.

Certain embodiments are described in higher detail below with reference to the accompanying drawings.

In the following description, like drawing reference numerals are used for the like elements, even in different drawings. The matters defined in the description, such as detailed construction and elements, are provided to assist in a comprehensive understanding of embodiments. However, embodiments can be practiced without those specifically defined matters. Also, well-known functions or constructions are not described in detail since they would obscure the application with unnecessary detail.

FIG. 1 is a view illustrating a speaker controlling system according to an embodiment. Referring to FIG. 1, the speaker controlling system includes a data processing apparatus 100, mobile device 200, and a plurality of speakers 300-1, 300-2, . . . 300-*n*.

The data processing apparatus 100 may be an apparatus that is capable of processing data, for example, a desktop computer, notebook computer, and tablet PC and so forth. Furthermore, the data processing apparatus 100 may store data or files in a hard disk or memory, and may also process these data or files. Herein, such data or files may include multimedia data including audio data or audio-video data.

The mobile device 200 is may be a portable apparatus, for example, various types of apparatuses such as a mobile phone, smart phone, tablet PC, PDA, and notebook PC and so forth.

A plurality of speakers 400-1, 400-2, . . . , 400-*n* are apparatuses that receive an audio signal from an external apparatus and output the received audio signal. Herein, an external apparatus may be a data processing apparatus 100 or mobile device 200 aforementioned, or a USB.

Referring to FIG. 1, an AP 10 forms a wired/wireless AP (Access Point) network. A plurality of speakers 300-1, 300-2, . . . , 300-*n* may be connected to the AP network via wireless communication (for example, WiFi). When the mobile device 200 is connected to the AP network, the mobile device 200 may control the plurality of speakers 300-1, 300-1, . . . , 300-*n*.

More specifically, when a predetermined event occurs with the mobile device 200 outputting an audio signal, the mobile device 200 may transmit the audio signal to at least one speaker of the plurality of speakers 400-1, 400-2, . . . , 400-*n* existing on the AP network. Therefore, the at least one speaker becomes capable of outputting the audio signal.

Meanwhile, when the mobile device 200 is connected to the AP network, the plurality of speakers 400-1, 400-2, . . . , 400-*n* may provide their information to the mobile device 200. Therefore, using this information, the mobile device 200 may display a UI screen (graphical UI) where the plurality of speakers connected to the AP network may be selected. Therefore, the mobile device 200 may control speakers selected from the UI screen of the plurality of speakers 400-1, 400-2, . . . , 400-*n*.

In FIG. 1, it is illustrated that the mobile device 200 transmits an audio signal being output from an internal speaker to at least one of the plurality of speakers 400-1, 400-2, . . . , 400-*n*, but there is no limitation thereto. More specifically, the mobile device 200 may obtain audio data information stored in the data processing apparatus 100, process the audio data information, and transmit the processed audio data information to at least one of the plurality of speakers 400-1, 400-2, . . . , **400-*n*. In such a case, the mobile device 200 may obtain audio data information from the data processing apparatus 100** by executing a predetermined application program installed therein.

As such, the mobile device 200 may output an audio signal being output from the mobile device 200 using at least one of the plurality of speakers 400-1, 400-2, . . . , **400-*n* connected to a same AP network. Therefore, it becomes easy to convert an apparatus from which an audio signal is to be output from the mobile device 200** to at least one speaker.

Furthermore, the mobile device 200 may individually or simultaneously control the plurality of speakers 400-1, 400-2, . . . , **400-*n*** connected to the same AP network, thereby making controlling of the speakers easier.

Meanwhile, the data processing apparatus 100 may transmit an audio signal to at least one of the plurality of speakers 400-1, 400-2, . . . , **400-*n*. In such a case, the data processing apparatus 100 may transmit an audio signal being output from at least one speaker to the mobile device 200** according to a predetermined event. Therefore, the data processing apparatus may have the audio signal being output from at least one speaker be output via an internal speaker.

Figure 2:
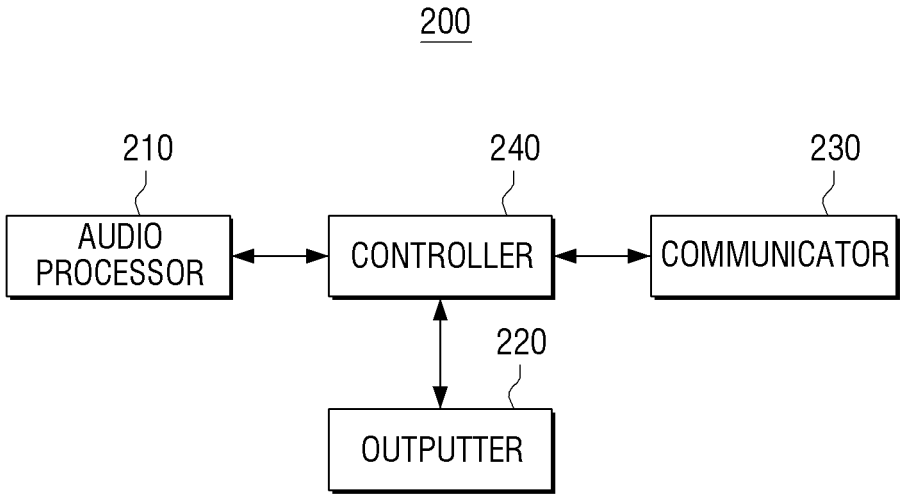
FIG. 2 is a block diagram illustrating a configuration of a mobile device according to an embodiment.

FIG. 2 illustrates a block diagram of a configuration of a mobile device according to an embodiment. Referring to FIG. 2, the mobile device 200 includes an audio processor 210, outputter 220, communicator 230, and controller 240.

The audio processor 210 processes audio data and generates an audio signal. The audio processor 210 may process audio data according a format of the audio data. For example, when the audio data has a WMA (Window Media Audio) format, the audio processor 210 may process the audio data using a WMA codec.

The WMA format is just an example, and thus the audio data may have a format including, but is not limited to, MP3, AAC (Advanced Audio Codec), OGG (OGG Vorbis), and so forth.

The outputter 220 outputs the audio signal processed in the audio processor 210. That is, the outputter 220 may be a speaker mounted onto or in the mobile device 200.

The communicator 230 may be a communication module that is capable of performing wireless communication. Therefore, the communicator 230 may be connected to at least one AP network provided where the mobile device 200 is located.

More specifically, when the mobile device 200 is at a certain location, the communicator 230 receives AP information from an AP provided at that location, and transmits the AP information to the controller 240. When the controller 240 controls a connection with the AP using the AP information, the communicator 230 may be connected to the AP network formed by the AP.

The controller 240 controls overall operations of the mobile device 200.

More specifically, the controller 240 may control an operation of outputting an audio signal from the mobile device 200, and may also control an operation of external speakers connected to a same AP network with the mobile device (for example, a plurality of speakers 400-1, 400-2, . . . , **400-*n* illustrated in FIG. 1**).

First of all, when a predetermined event occurs with an audio signal being output through the outputter 220, the controller 240 transmits the audio signal to an external speaker included in the AP network through the communicator 230. Therefore, the controller 240 may control the external speaker to output the audio signal that was being output from the mobile device 200.

Herein, the predetermined event may be an event of the mobile device 200 accessing the AP network to which the external speaker is connected, an event of an earphone jack connected to the mobile device 200 being detached, or an event of the mobile device 200 being tagged to the external speaker. Operations of the controller 240 in the case of each event will be explained herein below with reference to FIG. 3.

When one external speaker is included in the AP network, the controller 240 may automatically transmit the audio signal to the one external speaker. However, when a plurality of external speakers are included in the AP network as illustrated in FIG. 1, the controller 240 may transmit an audio signal to only the one predetermined reference speaker. When there is no predetermined reference speaker, the controller 240 may transmit an audio signal to all the external speakers.

As aforementioned, the mobile device 200 may control operations of an external speaker such that the external speaker outputs an audio signal by transmitting the audio signal to the external speaker connected to a same AP network.

The Illustration in FIG. 2 is based on the feature of the mobile device 200 controlling an external speaker. However, there is no limitation thereto, and thus as illustrated in FIG. 1, the data processing apparatus 100 connected to the AP network may control the mobile device 200 or external speaker.

More specifically, with the data processing apparatus 100 transmitting an audio signal to an external speaker, when the mobile device 200 exits the AP network, or the earphone jack is attached to the mobile device 200, or when the mobile device 200 is untagged to the external speaker from which the audio signal is being output, transmission of the audio signal to the external speaker stops. Furthermore, the data processing apparatus 100 transmits the audio signal to the mobile device 200, so that the audio signal may be output from the mobile device 200.

Figure 3:
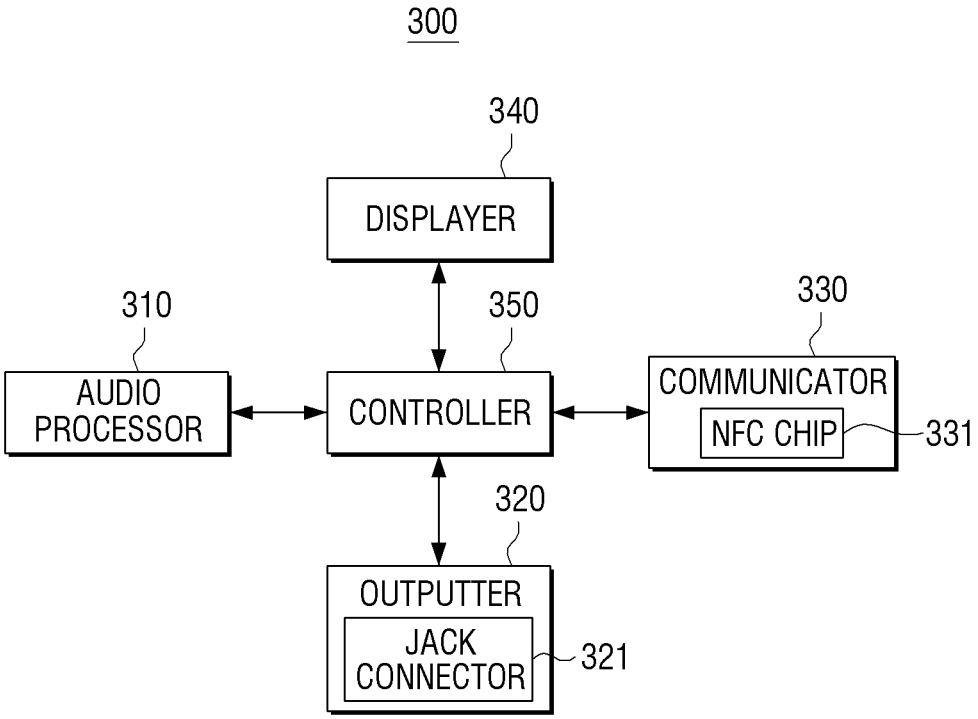
FIG. 3 is a block diagram illustrating a configuration of a mobile device according to another embodiment.

FIG. 3 is a block diagram illustrating a configuration of a mobile device according to another embodiment. Referring to FIG. 3, the mobile device 300 may include an audio processor 310, outputter 320, communicator 330, displayer or display 340, and controller 350.

The audio processor 310 processes audio data and generates an audio signal. Herein, the audio data may be audio data stored in the mobile device 300, or audio data being received from an internet server or broadcasting station server. Otherwise, it may be audio data obtained from a data processing apparatus connected to a same AP network as the mobile device 300.

The outputter 320 outputs the audio signal processed in the audio processor 310. The outputter 320 may be an internal speaker of the mobile device 300, or the outputter 320 may separately include a jack connector 321. Herein, the jack connector 321 is a component to which an earphone jack may be connected.

The communicator 330 is a communication module that is capable of performing wireless communication. Furthermore, the communicator 330 may include an NFC (Near Field Communication) chip 331 that supports a short-distance wireless communication method in addition to the wireless communication function.

The NFC chip 331 is a communication module that uses a non-contact short-distance wireless communication method using 13.56 Mz frequency band. Therefore, when the mobile device 300 approaches a communication subject device by not more than approximately 10 cm, the NFC chip 331 may transceive/transmit data to and from that communication subject device.

The displayer 340 displays a UI screen needed for controlling the external speaker. The displayer 340 may be a touch screen for receiving a user input.

The controller 350 may control operations of outputting an audio signal from the mobile device, and may control operations of the external speaker connected to a same AP network with the mobile device 300.

First of all, the controller 350 controls the outputter 320 to output the audio signal processed at the audio processor 310. In this case, the controller 350 may control the outputter 320 to output the audio signal if the earphone jack is not connected to the jack connector 321, and may control the jack connector 321 to output the audio signal, and if the earphone is connected to the jack connector 321.

Meanwhile, when a predetermined event occurs with an audio signal being output through the outputter 320 or jack connector 321, the controller 350 may transmit the audio signal to the external speaker connected to the AP network. Therefore, the controller 350 may stop the audio signal being output through the communication 320 or jack connector 321, and control the audio signal to be output through the external speaker.

Herein, the predetermined event may be one of an event of the mobile device 300 accessing the AP network to which the external speaker is connected, an event of the earphone jack being detached from the mobile device 300, and an event of the mobile device 300 being tagged to the external speaker.

When the mobile device 300 is accessed to the AP network, the controller 350 may determine that the event of the mobile device 300 accessing the AP network to which the external speaker is connected has occurred.

More specifically, when the mobile device 300 is accessed to or accesses the AP network to which the external speaker is connected, the AP forming the AP network transmits information of itself to the mobile device 300, and the communicator 320 receives this AP information.

The controller 350 checks whether or not the AP authentication information corresponding to the received AP information is pre-registered in the mobile device 300. If the AP authentication information is pre-registered in the mobile device 300, the controller 350 transmits the AP authentication information to the AP, and makes the communicator 320 access the AP network.

On the other hand, if the AP authentication information is not pre-registered in the mobile device 300, the controller 350 controls the displayer 340 to display a UI screen for receiving an input of the AP authentication information. Therefore, when the AP authentication information is input through the UI screen, the controller 350 may transmit the input AP authentication information to the AP and make the communicator 320 access the AP network.

As aforementioned, when the communicator 320 is accessed to or accesses the AP network, the controller 350 may transmit the audio data to the external speaker included in the AP network. In this case, the communicator 320 may receive information on the external speaker included in the AP network through the AP, and may communicate with the external speaker using the information on the external speaker.

Therefore, when an event of the mobile device 300 accessing the AP network to which the external speaker is connected occurs, the controller 350 may convert the apparatus for outputting the audio signal to the external speaker.

Meanwhile, when the earphone jack is detached from the jack connector 321 with the mobile device 300 accessed to the AP network to which the external speaker is connected and with the audio signal being output through the earphone jack connected to the jack connector 321, the controller 350 may determine that an event of the mobile device 300 being detached from the earphone jack has occurred.

When the earphone jack is detached from the jack connector 321, the controller 350 may transmit the audio data to the external speaker included in the AP network. That is, the controller 350 may convert the device to output the audio signal to the external speaker according to the event of the earphone jack being detached from the mobile device 300.

Meanwhile, when the NFC chip 331 communicates with the NFC module provided in the external speaker with the mobile device 300 accessed to the same AP network as the external speaker, the controller 350 may determine that an event of the mobile device 300 being tagged to the external speaker has occurred.

When the mobile device 300 is tagged to the external speaker, the controller 350 may transmit the audio signal to the tagged external speaker. That is, the controller 350 may convert the device to output the audio signal to the external speaker according to the event of the mobile device 300 being tagged to the external speaker.

As aforementioned, when predetermined events occur, by transmitting the audio signal being output through the outputter 320 or the jack connector 321 to the external speaker, the controller 350 may make the audio signal be output through the external speaker.

Hereinabove, it was explained that when a predetermined event occurs with the mobile device 300 outputting an audio signal, the audio signal is transmitted to the external speaker. However, when the user selects the external speaker as the device to output audio data with the mobile device 400 not outputting the audio signal, the mobile device 300 may transmit the audio data to output to the external speaker.

When there is one external speaker included in the AP network, the controller 350 may automatically transmit the audio signal to that one external speaker. However, when there are a plurality of external speakers included in the AP network, the controller 350 may transmit the audio signal to only one predetermined reference speaker.

Furthermore, when there is no predetermined reference speaker, the controller 350 may control the displayer 340 to display a UI screen for selecting the external speaker to output the audio signal of the plurality of external speakers.

Herein, the UI screen may include all external speakers connected to the same AP network with the mobile device 300 in a list format. Therefore, when the user selects at least one external speaker on the UI screen, the controller 350 may transmit the audio signal to the at least one external speaker selected. In this case, the external speaker selected on the UI screen may be one or plural.

Meanwhile, the user may make a plurality of external speakers into one group on or using the UI screen. If two external speakers are made into one group on the UI screen, the controller 350 may transmit the same audio signal to the two external speakers included in the group. In this case, the controller 350 may transmit group information to the two external speakers included in the group. Grouping information may be speaker information included in one group.

Furthermore, when a control signal such as an on/off or volume adjustment of the external speaker, or a sound effect (for example, stereo, echo, low sound reinforcement effect and so forth) is input, the controller 350 transmit the control signal to the two external speakers included in the group and control the two external speakers at the same time. Therefore, there is no need to control the plurality of external speakers individually, thereby being capable of easily controlling the plurality of external speakers.

On the UI screen, one group may be designated, or a plurality of groups may be designated. When a plurality of external speakers are grouped in a plurality of channel groups, the controller 350 may transmit a channel signal corresponding to each group.

More specifically, an audio signal may include two channel signals such as a right channel and left channel. Therefore, when a first and second channel groups are designated on the UI screen, the controller 350 may transmit an audio signal of a right channel to the plurality of external speakers included in the first channel group, and transmit an audio signal of a left channel to a plurality of external speakers included in the second channel group.

Meanwhile, when a speaker conversion command is input with an audio signal being output from one of the plurality of external speakers included in the AP network, the controller 350 may stop the audio signal transmission to the first external speaker, and transmit the audio signal to the second external speaker according to the speaker conversion command. On the UI screen for selecting an external speaker to output an audio signal, when another external speaker and not the external speaker that is currently outputting the audio signal is selected, the speaker conversion command may be input. Therefore, the external speaker to output the audio signal may be converted to from the first external speaker to the second external speaker.

Meanwhile, in the case where the controller 350 transmits an audio signal to the plurality of external speakers included in the AP network, audio signals of different volume levels may each be transmitted to the plurality of external speakers based on the distance between each external speaker and the mobile device 300.

More specifically, the controller 350 may transmit an audio signal of a high volume level to the external speaker located far away from the mobile device 300, and transmit an audio signal of a low volume level to the external speaker located close to the mobile device 300. Therefore, by changing the volume of an audio signal according to the location of the user having the mobile device 300, the user is enabled to hear the audio signal in a certain volume.

In this case, the distance between each of the plurality of external speakers and the mobile device 300 may measure or gauge the intensity of the signal being received from the plurality of external speakers or be set by the user. More specifically, the controller 350 may transmit a control signal requesting transmission of a same signal to the plurality of external speakers. When the plurality of external speakers transmit a predetermined signal according to this control signal, the controller 350 may measure the intensity of these signals received through the communicator 330 to determine how far the mobile device 300 is in distance away from each of the plurality of external speakers. Otherwise, the distance regarding each of the plurality of external speakers may be input by the user through the UI screen.

As such, the mobile device 300 may control operations of the plurality of speakers 400-1, 400-2, . . . , **400-*n*** connected to a same AP network individually or in groups.

Figure 4:
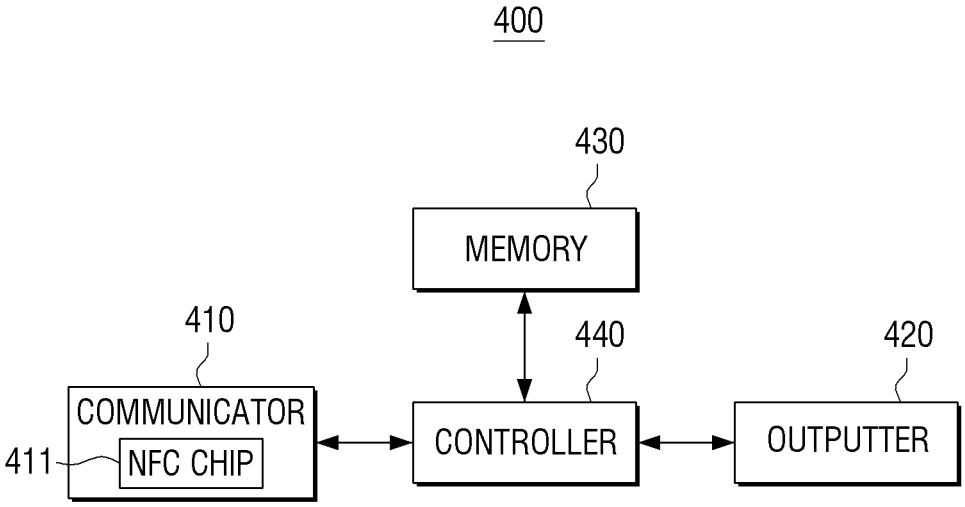
FIG. 4 is a block diagram illustrating a configuration of a speaker according to an embodiment.

FIG. 4 is a block diagram illustrating a configuration of a speaker according to an embodiment.

Referring to FIG. 4, the speaker 400 includes a communicator 410, outputter 420, memory 430, and controller 440. The speaker 400 is a sound amplifier that receives an audio signal from an external device, and outputs the audio signal in a sound form.

The communicator 410 is a communication module that may perform wireless communication such as a WiFi, and the communicator 410 may be connected to an AP (Access Point) network. Furthermore, the communicator 410 may include an NFC chip 411 using a short-distance wireless communication method. Therefore, when the mobile device 300 illustrated in FIG. 3 approaches within approximately 10 cm to the speaker 400, data transmission may be performed between two NFC chips 331, 411.

In FIG. 4, the NFC chip 411 is illustrated as being a component included in the communicator 410, but it can also be a separate component from the communicator 410.

The outputter 420 outputs an audio signal.

The memory 430 stores speaker information. Herein, speaker information may be speaker identification information indicating that the device is a speaker, or specification information, such as a model name, frequency information, and sound output information of the speaker 400. And the speaker information may include AP network information to which the speaker 400 is currently connected.

The controller 440 controls overall operations of the speaker 400.

First of all, when the mobile device is accessed to or accesses the AP network with the mobile device being connected to a predetermined AP network by the communicator 410, the controller 440 may read the speaker information from the memory 430 and transmit the speaker information to the mobile device.

More specifically, when the mobile device is accessed or accesses to the AP network, the communicator 410 may receive information on the mobile device from the AP forming the AP network. The controller 440 may control the communicator 410 to transmit speaker information to the mobile device using the information on the mobile device. In such a process, the speaker 400 and the mobile device become capable of communicating with each other.

Meanwhile, when an audio signal is received from the mobile device, the controller 440 may control the outputter 420 to output the received audio signal. As such, when the audio signal is received from the mobile device, a command for outputting the audio signal may be received together with the signal.

Furthermore, when a control signal such as an on/off or volume adjustment, or sound effect (for example, stereo, echo, and low sound reinforcement effect and so forth) is received from the mobile device besides the audio signal, the controller 440 may perform operations according to the control signal.

Meanwhile, when the audio signal is output through the outputter 420, the controller 440 may communicate with other speakers connected to the AP network, and mutually transceive/transmit between one another information on the audio signal currently being output, and information on the device that is transmitting the audio signal to each speaker (for example, mobile device).

Therefore, the controller 440 may use the information received from other speakers to synchronize with the speakers that are outputting the same audio signal. Especially, when the speaker 400 is grouped with other speakers connected to the AP network, the speaker 400 may receive group information regarding the grouping from the mobile device in advance. Therefore, the controller 440 may synchronize the audio signal being output with other speakers included in the same group as itself.

Figure 5A:
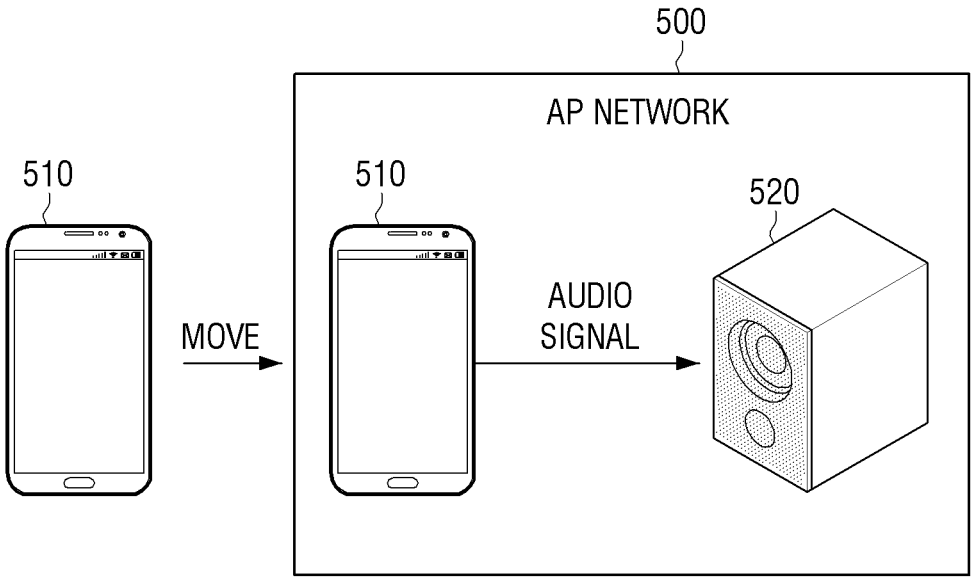
FIGS. 5*a* to 5*c* are views for explaining a speaker controlling method according to various embodiments.
Figure 5B:
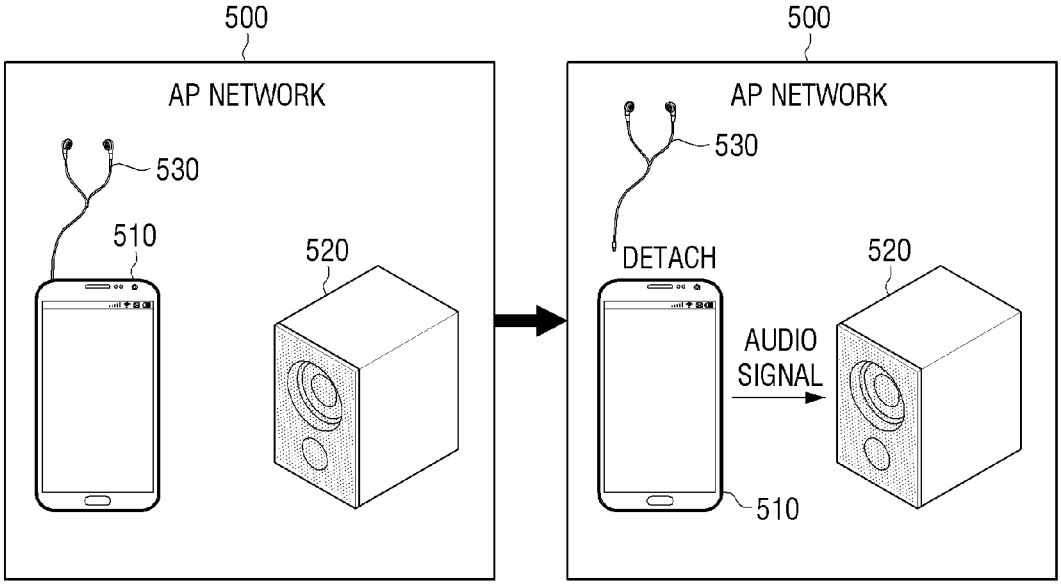
Figure 5C:
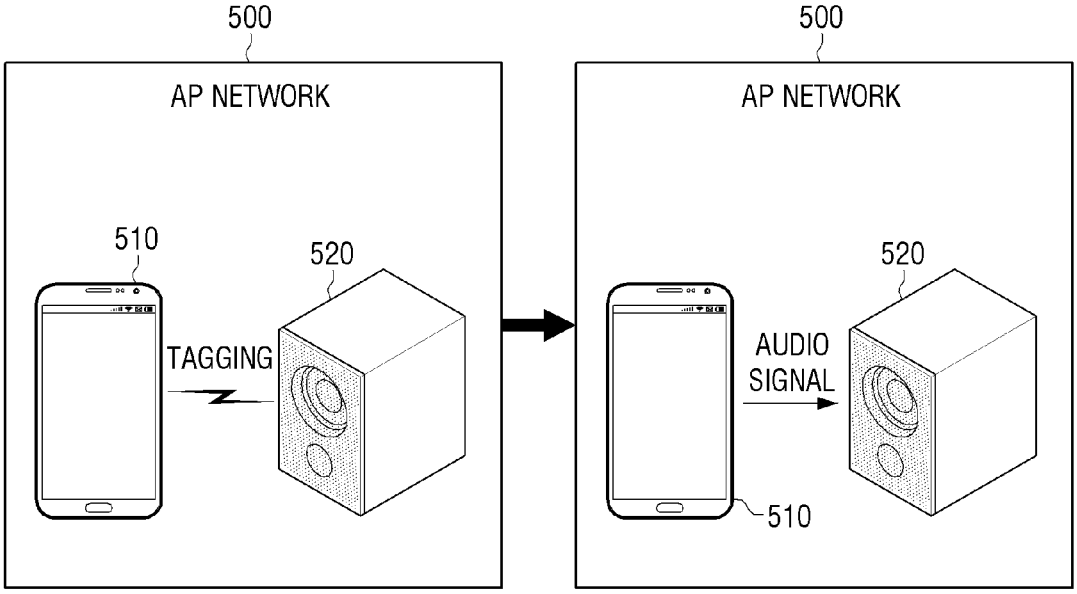

FIGS. 5*a* to 5*c* are views for explaining a speaker controlling method according to various embodiments. FIGS. 5*a* to 5*c* illustrate methods for outputting an audio signal that is being output from the mobile device 510 through a speaker 520 connected to a same AP network 500.

First of all, referring to FIG. 5*a*, when moving to or into an AP network 500 area with the mobile device 510 outputting an audio signal, the mobile device may be accessed to or access this AP network 500. In this case, the mobile device 510 may stop outputting the audio signal, and transmit that audio signal to the speaker 520 included in the AP network 500.

Referring to FIG. 5*b*, with the mobile device 510 already accessed to or accessing the AP network 500 and outputting an audio signal through an earphone 530 connected to the mobile device 510, when the earphone 530 is detached from the mobile device 510, the mobile device 510 may stop outputting the audio signal and transmit that audio signal to the speaker 520 included in the AP network.

Referring to FIG. 5*c*, with the mobile device 510 already accessed to or accessing the AP network 500 and outputting an audio signal, when the mobile device 510 is tagged to the speaker 520, the audio signal may be transmitted to the speaker 520.

Meanwhile, in FIGS. 5*a* to 5*c*, even when the mobile device 510 stops outputting an audio signal and then immediately transmits the audio signal to the speaker 520, the audio signal may not be output immediately from the speaker 520 due to the transmission time of the audio signal.

Furthermore, in the case of outputting the audio signal from the speaker 520 as soon as the mobile device 510 stops outputting the audio signal, people nearby including the user may be surprised by the sound suddenly being output from the speaker 520.

Considering the aforementioned, the mobile device 510 may stop outputting the audio signal, such that the volume of the audio signal is gradually turned down, and then transmit the audio signal to the speaker 520, such that the volume of the audio signal is gradually turned up. Therefore, the speaker 520 may output the audio signal seamlessly, and may also let nearby people know that an audio signal will be output.

FIGS. 6*a* to 6*d* are views illustrating various UI screens used to control an external speaker.

Figure 6A:
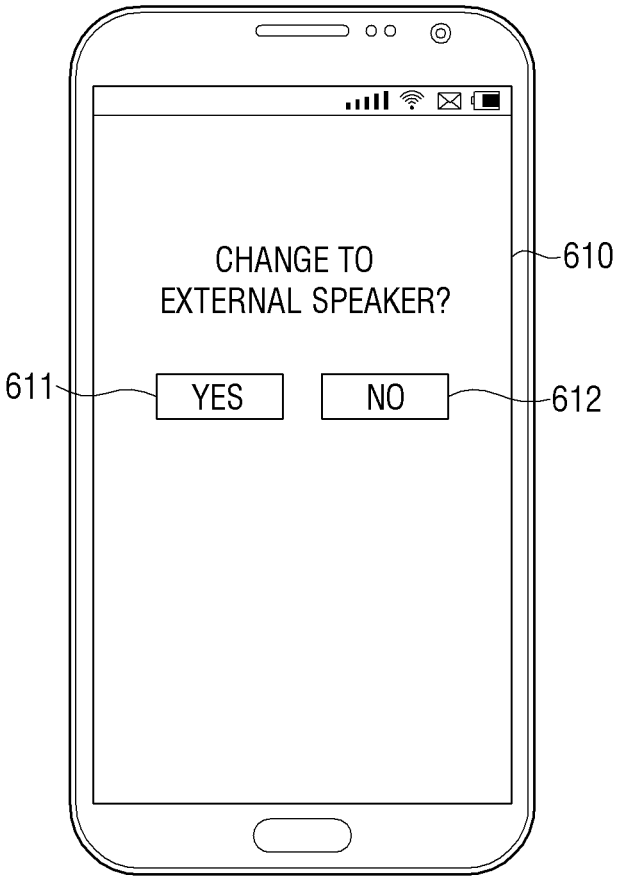
FIGS. 6*a* to 6*d* are views illustrating various UI screens used in controlling an external speaker.

As in FIGS. 5*a* to 5*c*, in the case where events satisfying conditions for converting the device to output an audio signal occur, the mobile device 510 may display a first UI screen 610 as illustrated in FIG. 6*a*.

The first UI screen 610 is a screen for checking whether or not to convert the device or system to output an audio signal to a speaker 520. When "yes 611" is selected on the first UI screen, the mobile device 510 may transmit an audio signal to the speaker 520.

On the other hand, when "no 612" is selected on the first UI screen 610, the mobile device may not transmit an audio signal to the speaker 520, and may continue to output an audio signal through an internal speaker.

Therefore, when the speaker 520 is located in a public place or where it needs to be quiet, the user may select not to output an audio signal through the speaker 520.

Figure 6B:
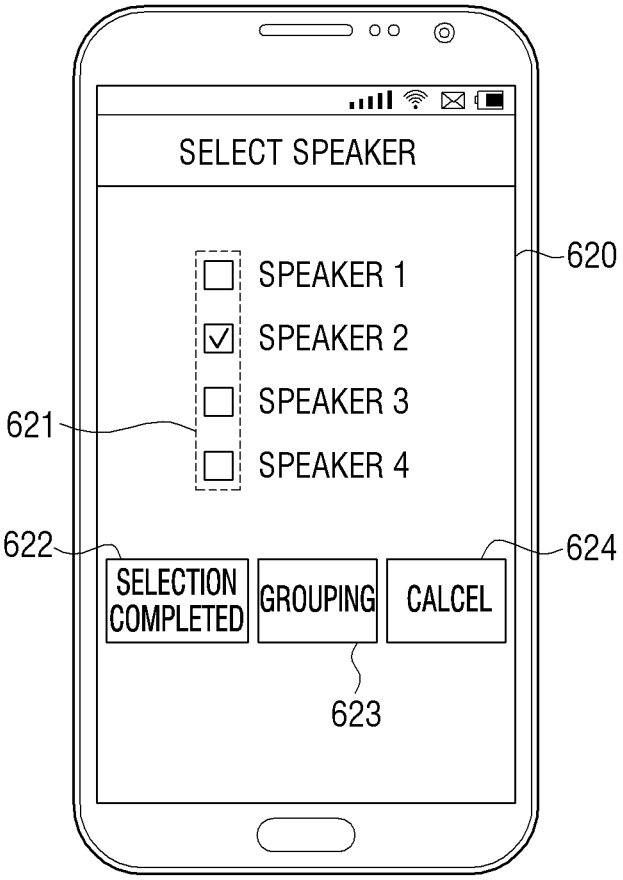

Meanwhile, in FIGS. 5*a* to 5*c*, since only one speaker 520 is included in the AP network, when "yes 611" is selected on the first UI screen 610, the mobile device 510 transmits an audio signal to the speaker 520 immediately. However, when a plurality of speakers are included in the AP network 500, the mobile device 510 may display a second UI screen 620 as illustrated in FIG. 6*b*.

The second UI screen 620 is a screen for selecting an external speaker to output an audio signal of a plurality of speakers. When speaker 1, speaker 2, speaker 3, and speaker 4 are included in the AP network 500, the second UI screen 620 includes 4 speakers in a list format, and includes a selecting area 621 for selecting the 4 speakers individually.

When speaker 2 is selected in the selecting area 621, and "selection completed 622" is selected, the mobile device 510 may transmit an audio signal to speaker 2, and control speaker 2 to output the audio signal.

With the mobile device 510 outputting an audio signal to speaker 2 as aforementioned, a second UI screen 620 may be displayed according to the user's manipulation. Herein, the second UI screen 620 may display a text such as "being used" or "outputting" in a list of speaker 2 that is currently outputting the audio signal.

As such, on the second UI screen 620, when "selection completed 622" is selected after selection of speaker 2 is released and speaker 3 is selected, the mobile device 510 may stop transmitting an audio signal to speaker 2 and transmit the audio signal to speaker 3.

Meanwhile, when two or more speakers are selected in the selecting area 621 and "selection completed" is selected, the mobile device 510 may transmit an audio signal to the selected two or more speakers.

Figure 6C:
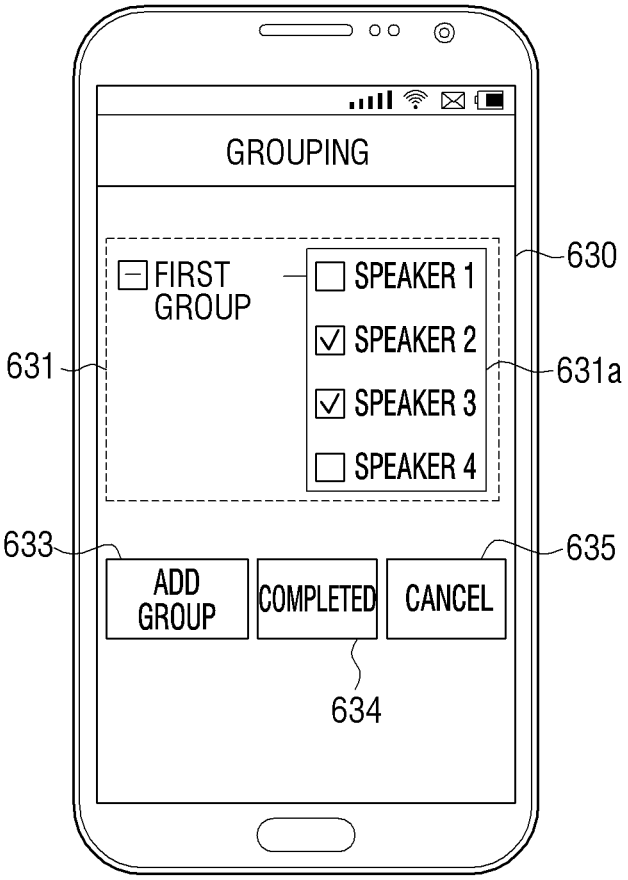

Furthermore, when "grouping 623" is selected on the second UI screen 620, the mobile device 510 displays a third UI screen 630 illustrated in FIG. 6*c*.

A third UI screen 630 is a screen for grouping a plurality of speakers. When intending to control two or more speakers at the same time, the user may group two or more speakers on the third UI screen 630.

The third UI screen 630 includes a first group area 631, and the first group area 631 includes a selecting area 631*a* for selecting speakers to be grouped.

The selecting area 631*a* may include all 4 speakers included in the AP network 500. When speaker 2 and speaker 3 are selected in the selecting area 631*a* and "completed 634" is selected, the mobile device 510 may group speaker 2 and speaker 3 into a first group, and transmit a same audio signal to speaker 2 and speaker 3.

Furthermore, with speaker 2 and speaker 3 grouped, when the mobile device 510 controls the on/off, volume adjustment or sound effect (for example, stereo, echo, low sound reinforcement effect and so forth) of the speaker, it is possible to control speaker 2 and speaker 3 that belong to the first group at the same time.

In the selecting area 631*a*, when speaker 2 and speaker 3 are selected, and "add group 633" is selected, the mobile device 510 may additionally display a second group area (not illustrated) on a third screen 630. Herein, the second group area (not illustrated) may have the same configuration as the first group area 631, except that speaker 2 and speaker 3 that have already been selected in the first group area 631 may be displayed as being in a non-selectable state.

When "cancel 635" is selected on the third UI screen 630, the mobile device 510 may continue to output an audio signal through the internal speaker without transmitting the audio signal to the plurality of speakers.

Figure 6D:
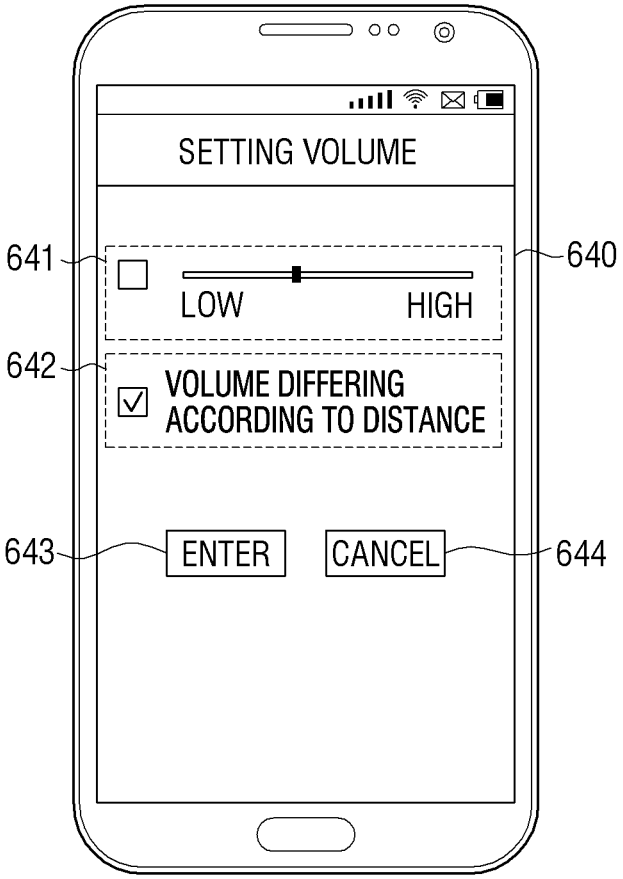

When a plurality of speakers are selected on the second UI screen 620 illustrated in FIG. 6*b*, or when a plurality of speakers are grouped on the third UI screen 630 illustrated in FIG. 6*c*, the mobile device 510 displays a fourth UI screen 640 illustrated in FIG. 6*d*.

The fourth UI screen 640 is a screen for setting a volume of the plurality of speakers, and includes a first area 641 for manually adjusting the volume and a second area 642 for applying a different volume according to distance.

When intending to apply a same volume to the plurality of speakers, the user may select the first area 641 and adjust the volume between LOW and HIGH.

Furthermore, when intending to apply a different volume according to distance regarding the plurality of speakers, the user may select the second area 642. Herein, a distance may be the distance between each of the plurality of speakers and the mobile device 510. Therefore, operations when the second area 642 is selected will be explained in detail herein below with reference to FIG. 7.

Figure 7:
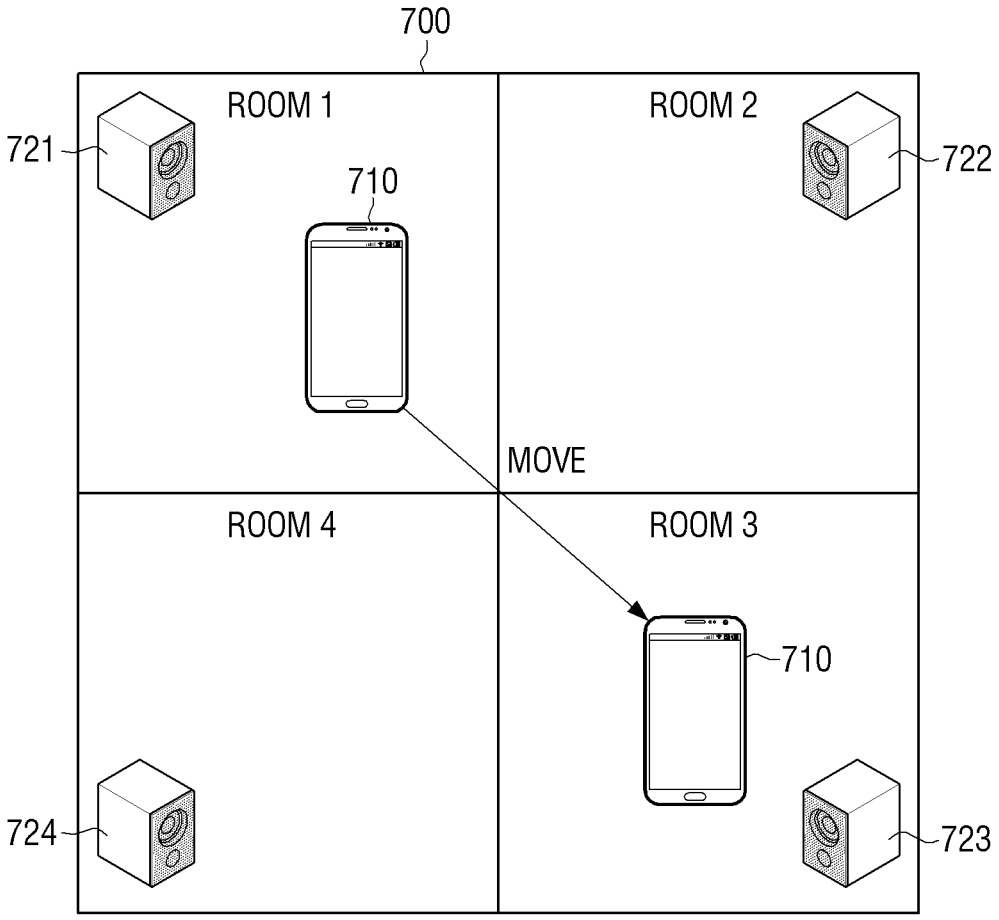
FIG. 7 is a view for explaining a method for controlling a volume level of an audio signal according to an embodiment.

FIG. 7 is a view for explaining a volume level controlling method of an audio signal according to an embodiment. As in FIG. 7, when a house 700 includes four rooms, and each of a plurality of speakers 721, 722, 723, 724 is located in each of the four rooms, the mobile device 710 may transmit an audio signal to each speaker 721, 722, 723, 724 located in each room, so that an audio signal may be output from each speaker 721, 722, 723, 724 located in each room.

In this case, the mobile device 710 may transmit an audio signal of different level to each of the four speakers. More specifically, the mobile device 710 transmits an audio signal of different level to each of the four speakers according to the distance between each of the four speakers and the mobile device 710.

For example, when the mobile device 710 is located in room 1, the mobile device 710 may transmit an audio signal of a low volume level to speaker 1 that is located in room 1, and transmit an audio signal of a high volume level to speaker 2, speaker 3, and speaker 4 located in room 2, room 3, and room 4, respectively.

Furthermore, when the mobile device 710 is moved from room 1 to room 3, the mobile device may transmit an audio signal of a low volume level to speaker 3 located in room 3, and transmit an audio signal of a high volume level to speaker 1, speaker 2, and speaker 4 located in room 1, room 2, and room 4, respectively.

Therefore, considering the fact that the user possesses the mobile device 710, it is possible to adjust the volume of an audio signal according to the location of the user of the mobile device. Therefore, the user may hear an audio signal by or at a certain volume wherever he/she is in the house 700.

Figure 8:
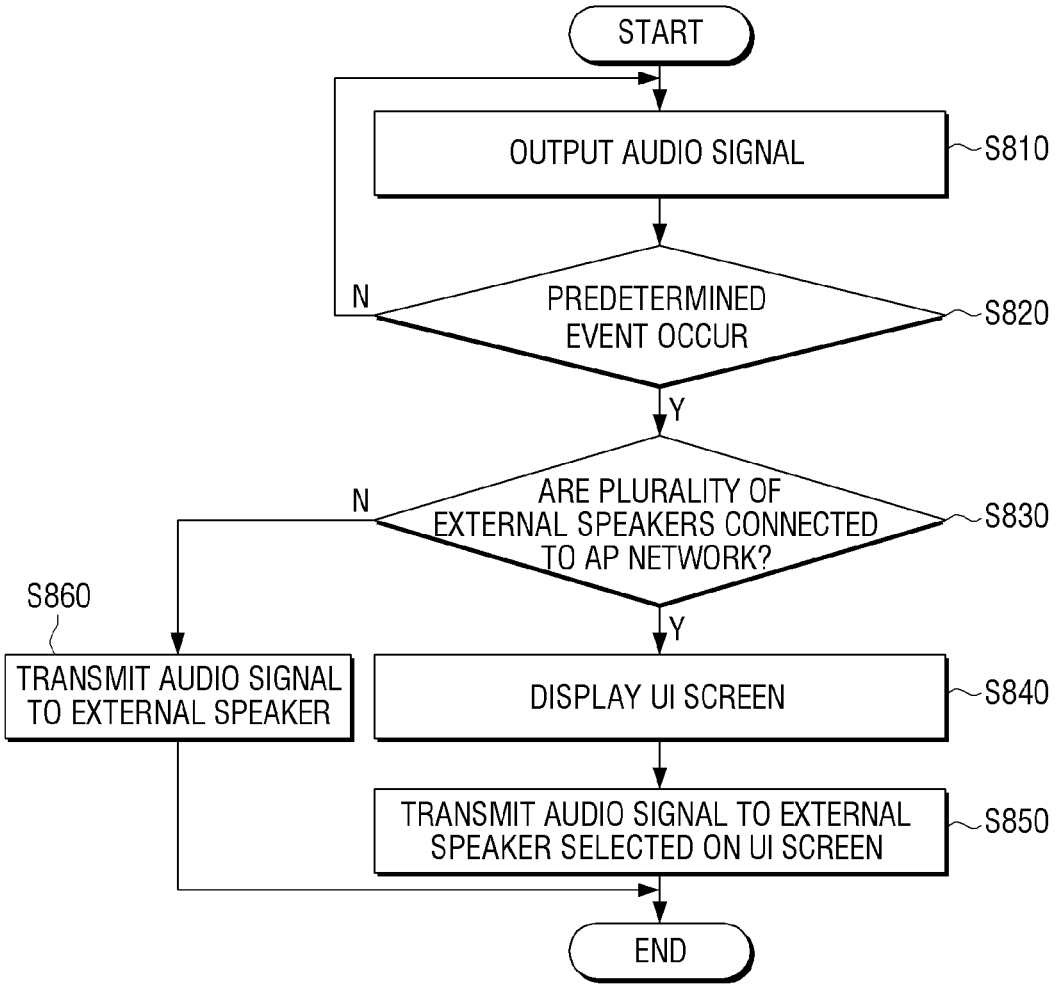
FIG. 8 is a flowchart for explaining a speaker controlling method according to an embodiment.

FIG. 8 is a flowchart for explaining a speaker controlling method according to an embodiment. The speaker controlling method illustrated in FIG. 8 is performed in a mobile device according to an embodiment, and relates to an embodiment where one speaker is included in the AP network.

Referring to FIG. 8, the mobile device outputs an audio signal (S810). When a predetermined event occurs with the audio signal being output as aforementioned (S820), the mobile device checks whether or not an external speaker connected to a same AP network as the mobile device is plural speakers (S830).

If it is checked that a plurality of external speakers are connected to the AP network, the mobile device displays a UI screen for selecting at least one speaker to output an audio signal (S840). Herein, the UI screens being displayed are as illustrated in FIGS. 6*a* to 6*d*, and thus detailed explanation is omitted.

The mobile device transmits the audio signal to a selected external speaker on the UI screen (S850). Therefore, the mobile device may output the audio signal through the plurality of speakers connected to the AP network.

Meanwhile, if one external speaker is connected to the AP network, the mobile device transmits the audio signal to the external speaker (S860). Therefore, when a predetermined event occurs, the mobile device transmits the audio signal to the one external speaker right away, thereby automatically converting the device to output an audio signal.

A speaker controlling method according to the aforementioned various embodiments may each be coded in software and be recorded in a non-transitory computer readable medium. A non-transitory computer readable medium may be installed in various types of mobile devices, and accordingly, the aforementioned speaker controlling method may be embodied in various mobile devices.

A non-transitory computer readable medium refers to a medium that stores data semi-permanently and not for a short period of time such as a resistor, cache, and memory and so forth. More specifically, the aforementioned various applications or programs may be stored and provided in a non-transitory computer readable medium such as a CD, DVD, hard disk, blue ray disk, USB, memory card, and ROM.

Although a few embodiments have been shown and described, it would be appreciated by those skilled in the art that changes may be made in this embodiment without departing from the principles and spirit of the embodiments, the scope of which is defined in the claims and their equivalents.

What is claimed is:

1. A mobile device, comprising:

an audio processor configured to process audio data;

an outputter mounted onto or in the mobile device configured to output the processed audio signal;

a communicator configured to communicate with an AP (Access Point) network; and a controller configured to determine whether an external speaker device exists in the AP network, in response to a predetermined event occurring while the processed audio signal is output through the outputter mounted onto or in the mobile device, to display a first user interface (UI) screen including a first UI item for transmitting the processed audio signal to a first external speaker device if only the first external speaker device exists in the AP network, and to display a second UI screen including a second UI item for selecting at least one among a plurality of external speaker devices if the plurality of external speaker devices exist in the AP network, wherein the controller is further configured to transmit, to the external speaker device selected through the second UI screen, a control signal to control a volume level of the selected external speaker device based on a distance between the selected external speaker device and the mobile device.

2. The device according to claim 1, wherein the outputter comprises a jack connector to which an earphone jack is connected, and in response to the earphone jack being connected thereto, outputting the processed audio signal through the earphone jack; and the predetermined event is that the earphone jack is detached from the jack connector.

3. The device according to claim 1, wherein the communicator comprises an NFC (Near Field Communication) chip for performing a short-distance wireless communication, and the predetermined event is that NFC tagging information is received from the NFC chip.

4. The device according to claim 1, wherein the controller, in response to the plurality of external speaker devices being grouped into one group on the second UI screen, transmits a same processed audio signal to the external speaker devices in the group.

5. The device according to claim 1, wherein the controller, in response to the processed audio signal comprising a plurality of channel signals and the plurality of external speaker devices being grouped in a plurality of channel groups on the second UI screen, transmits a channel signal corresponding to each group.

6. The device according to claim 1, wherein the controller, in response to a speaker device conversion command being input with respect to the first external speaker device of a plurality of external speaker devices included in the AP network outputting the processed audio signal, stops transmitting the processed audio signal to the first external speaker device, transmits the processed audio signal to a second external speaker device of the plurality of external speaker device, and controls the second external speaker device to output the processed audio signal.

7. A speaker device controlling method of a mobile device, the method comprising:

processing audio data;

outputting, by outputter mounted onto or in the mobile device, the processed audio signal;

determining whether an external speaker device exists in the AP network; and in response to a predetermined event occurring while the processed audio signal is output by outputter mounted onto or in the mobile device, displaying a first user interface (UI) screen including an UI item for transmitting the processed audio signal to a first external speaker device if only the first external speaker device exists in the AP network, and displaying a second UI screen including an UI item for selecting at least one among a plurality of external speaker devices if the plurality of external speaker devices exist in the AP network, wherein the controlling the external speaker device, in response to the external speaker device being plural speaker devices, transmits an audio signal of different volume level to each of the plurality of external speaker devices according to a distance between each of the plurality of external speaker devices and the mobile device, and outputs the audio signal.

8. The method according to claim 7, wherein the outputting outputs the processed audio signal through an earphone jack connected to a jack connector of the mobile device, and the predetermined event is that the earphone jack is detached from the jack connector.

9. The method according to claim 7, wherein the predetermined event is that NFC tagging information is received from the NFC chip.

10. The method according to claim 7, wherein the controlling the external speaker device, in response to the plurality of external speaker device being grouped into one group on the second UI screen, transmits a same processed audio signal to the external speaker device in the group.

11. The method according to claim 7, wherein the controlling the external speaker devices, in response to the processed audio signal comprising a plurality of channel signals and the plurality of external speaker devices being grouped into a plurality of channel groups on the second UI screen, transmits a channel signal corresponding to each group.

12. The method according to claim 7, wherein the controlling the external speaker device, in response to a speaker device conversion command being input with respect to a first external speaker device outputting the processed audio signal of a plurality of external speaker device included in the AP network, stops transmitting the processed audio signal to the first external speaker device, transmits the processed audio signal to a second external speaker device of the plurality of external speaker devices, and controls the second external speaker device to output the processed audio signal.

13. A system, comprising:

an audio speaker device;

a network connected to the speaker device; and a smart phone configured to be connectable to the network, determine whether audio speaker device exists in the network, display UI screens according to the number of the audio speaker device existing in the network and cause an audio signal to be sent to the speaker device when an event occurs in the smart phone while the audio signal is output through the smart phone, wherein the smart phone, in response to the audio speaker device being plural audio speaker devices, transmits an audio signal, of different volume level according to a distance between each of the plurality of audio speaker devices and the smart phone, to each of the plurality of audio speaker devices and outputs the audio signal.

* * * * *